US005182913A

United States Patent [19]

Robar et al.

[11] Patent Number: 5,182,913

[45] Date of Patent: Feb. 2, 1993

[54] ENGINE SYSTEM USING REFRIGERANT FLUID

[76] Inventors: Sheldon C. Robar, R.R. #1, Greenfield, Queens County, Nova Scotia, Canada, B0T 1E0; David W. Fraser, R.R. #3, Bridgewater, Nova Scotia, Canada, B4V 2W2; Bernard A. Wiley, 22 Farley Place, St. Thomas, Ontario, Canada, N5R 3E5

[21] Appl. No.: 646,183

[22] Filed: Jan. 28, 1991

[30] Foreign Application Priority Data

Dec. 31, 1990 [CA] Canada ..... 2033462

[51] Int. Cl.[5] ..... F01K 25/10

[52] U.S. Cl. ..... 60/671; 60/660

[58] Field of Search ..... 60/651, 671, 660

[56] References Cited

U.S. PATENT DOCUMENTS 3,531,933 10/1970 Baldwin ..... 60/671 X 4,109,468 8/1978 Heath ..... 60/671 X 4,738,111 4/1988 Edwards ..... 60/671

*Primary Examiner*—Allen M. Ostrager

*Attorney, Agent, or Firm*—Philip W. Jones

[57] ABSTRACT

An engine system using refrigerant fluid is capable of utilizing the heat produced by an external high-efficiency hydrocarbon fuel combustion process. The heat from that process is utilized to transform the refrigerant fluid from a liquid state to a gaseous state in a cycle which includes extracting work from the fluid in the gaseous state in a high-compression-ratio piston engine. The cycle further includes transforming the fluid in the gaseous state back to the liquid state in a condenser, and then feeding that fluid under pressure to a heating chamber where the combustion process heat again returns it to the gaseous state at high pressure and temperature. The engine system has a higher efficiency than hydrocarbon fuel combustion engines, and has particular application to use in automobiles. One preferred refrigerant fluid for this engine system is 2,2,Dichloro-1,1,1,Trifluoro-Ethane.

3 Claims, 5 Drawing Sheets

ENGINE SYSTEM USING REFRIGERANT FLUID

The present invention relates to an engine system, and more particularly, to an engine system that utilizes a refrigerant fluid as a working fluid.

Two drawbacks of conventional internal combustion engines are their inefficiency in utilizing increasingly-scarce hydrocarbon fuels and their creation of airborne pollutents. These factors are related in that an internal combustion engine, no matter how finely tuned, cannot fully utilize the combustion process. Rather, such an engine expels undesirable high-temperature combustion products, such as nitrogen oxides ($NO_x$), carbon monoxide (CO), and unburned hydrocarbons (HC). If an engine system could be developed that more fully utilized hydrocarbon fuels, such a system would have the twin advantages of taking more energy from the fuels while creating more acceptable byproducts.

The engine system of the invention produces these advantages by utilizing a refrigerant fluid, i.e. a fluid of the type normally utilized with refrigeration equipment, as a working fluid. A hydrocarbon fuel or other heat source, utilized in a high-efficiency combustion process, provides heat to a heating chamber into which the working fluid is directed. The working fluid is there transformed from a liquid phase to a gaseous phase. The gaseous working fluid is then directed to a two-stroke engine having a high-compression ratio; in some cases it may be possible to utilize a conventional diesel engine. As a portion of the pistons of the engine are driven downward by the pressure of working fluid that has entered through synchronized inlet valve means, the other pistons expel working fluid through synchronized outlet valve means. The working fluid, then at a reduced pressure, is directed to a condenser where it is returned to the liquid state by removal of heat. From the condenser the working fluid is ready to be pumped once again to the heating chamber. The efficiency of this engine system is estimated to be at least twice that of conventional hydrocarbon-fuel internal combustion engine systems.

In one form, the invention is an engine system that is adapted to employ a refrigerant fluid as a working fluid and comprises a condenser, a pump, a heating chamber, a heat source, and a two-stroke high-compression-ratio piston engine. The condenser removes heat from the working fluid such that the fluid is transformed from a gaseous state to a liquid state. The working fluid in the liquid state is pumped by the pump from the condenser to the heating chamber. The heat source supplies heat to the heating chamber such that the working fluid is transformed from the liquid state to the gaseous state.

The working fluid in the gaseous state drives a high-compression-ratio piston engine having reciprocating pistons connected to a rotatable crankshaft. The crankshaft has a series of journals each connected by a respective connecting rod to a respective one of the pistons. Each piston is housed in a cylinder having a working fluid inlet valve means and a working fluid outlet valve means, the total of the inlet valve means controlling flow of the working fluid to the engine from the heating chamber, and the total of the outlet valve means controlling the flow of the working fluid to the condenser from the engine. The rotation of the crankshaft determines the opening and closing of each of the inlet and outlet valve means. Each inlet valve means is open between approximately one-quarter and approximately one-half of the downward motion of the associated piston, and each outlet valve is open for substantially all of the upward motion of the associated piston.

The engine may be a two-stroke engine with an even number of cylinders. The crankshaft may have a series of journals arranged in pairs such that one of each pair extends in a direction angularly-opposed on the crankshaft from the other of that pair. Each pair of journals may occupy a respective one of a series of planes that together divide a circle normal to and centred on the crankshaft into a set of equiangular segments. Alternatively, all of the pairs of journals may occupy the same plane through the axis of the crankshaft; in this arrangement, as half of the pistons are moving through top-dead-center (TDC) the other half of the pistons are moving through bottom-dead-center (BDC).

It is also possible for the engine to be a two-stroke engine having an odd number of cylinders, although such engines are more difficult to build and balance than are engines with even numbers of cylinders.

The engine system may have a compression ratio of between approximately 12-to-1 and approximately 15-to-1. The pump may be driven by the piston engine, and may also have a throttle assembly for controlling the quantity of working fluid flowing to the piston engine from the heating chamber. If the engine system is installed into an automobile, the condenser may be a fan-cooled radiator and the piston engine may have at least four cylinders. The heating chamber may be one chamber of a heat exchanger having two chambers each on an opposite side of a heat conductive wall, combustion gases produced by the heat source being passed through the other chamber. The heat source may include a propane, gasoline or natural gas storage tank and an associated burner element. The engine system may further comprise a starter engine connectable to the crankshaft of the piston engine and powered by an electrical power storage means.

The pressure of the working fluid between the pump and the heating chamber and between the heating chamber and the piston engine may have a value between approximately 300 p.s.i.g. (pounds per square inch gauge) and approximately 800 p.s.i.g. The pressure of the working fluid between the piston engine and the condenser may have a value between approximately 0 p.s.i.g. and 50 p.s.i.g.

The engine system may further comprise a centrifugal advancement mechanism for advancing the opening and closing of each of the inlet and outlet valve means relative to the rotation of the crankshaft. The mechanism comprises a shaft connected to rotate with the crankshaft, a concentric cylinder mounted to surround the shaft, and a pair of arms mounted on the cylinder such that each arm extends diametrically opposite the other on the cylinder. The concentric cylinder is connected to a camshaft that determines the opening and closing of the each of the inlet and outlet valve means. Each arm is pivotally mounted on the cylinder such that a larger end of each arm moves outwardly on the cylinder against bias with increasing rotational speed of the cylinder. A second smaller end of each arm has a portion extending generally radially inwardly into the shaft. An increase in the rotational speed of the shaft results in a rotation of the arms which in turn results in the concentric cylinder rotating slightly relative to the shaft to advance the opening and closing of the inlet and outlet valve means relative to the rotation of the crankshaft.

The invention will next be more fully described by means of a preferred embodiment utilizing the accompanying drawings, in which.

Figure 1:
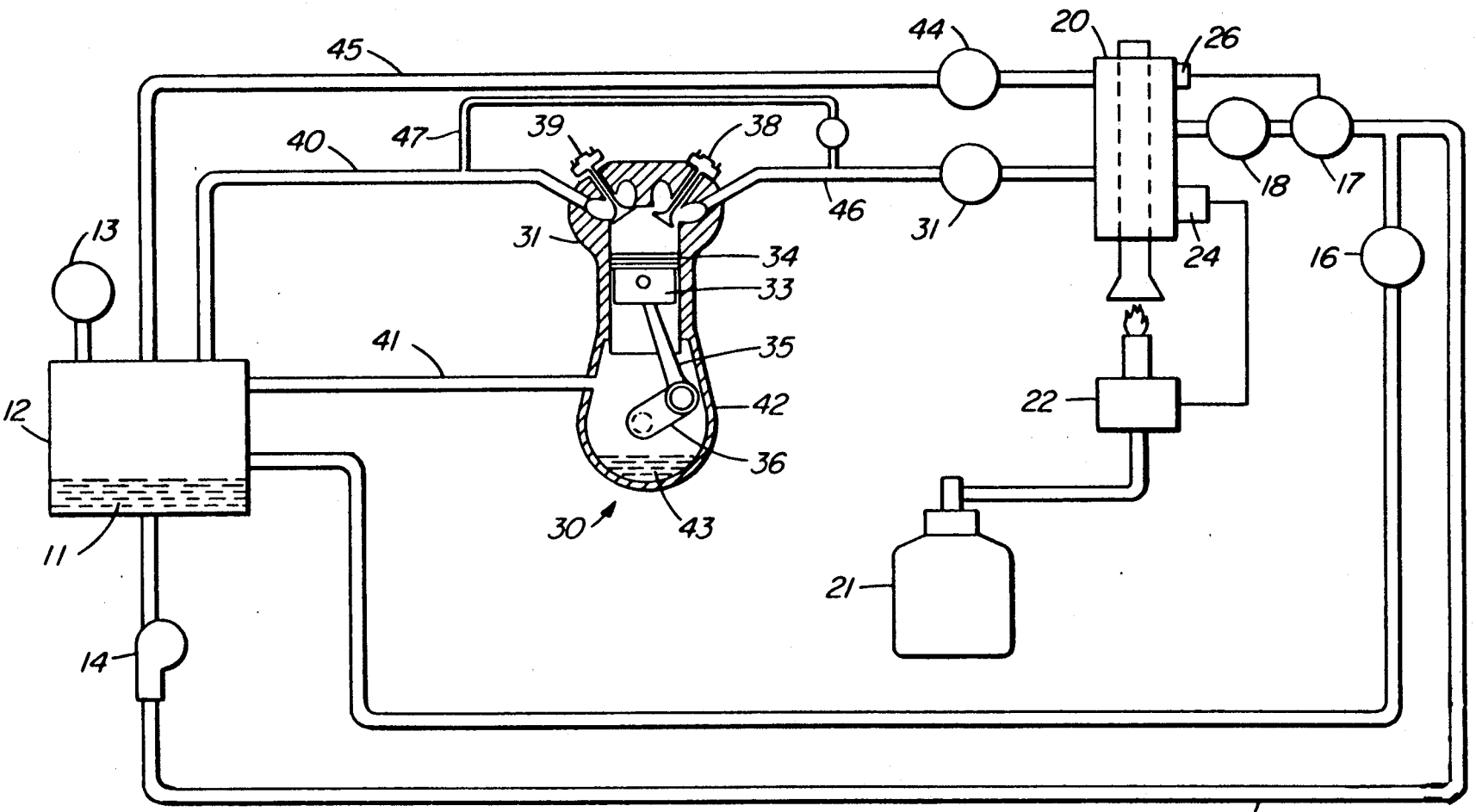
FIG. 1 is a partially-sectioned view of the engine system of the preferred embodiment.

With initial reference to FIG. 1, a liquid rerefrigerant fluid 11 sits in the bottom of a condenser 12. The liquid refrigerant fluid utilized in this embodiment is the commercially-available product known as "FREON 114", although other refrigerant fluids with better thermodynamic characteristics are presently under development for use in this process. An emergency relief valve 13 is fixed to condenser 12; it will only open if the pressure in condenser 12 should exceed a very high limit such as 1000 pounds per square inch (p.s.i.g.) due to a fire or similar cause. Condenser 12 may be air-cooled or liquid-cooled and could take the form, for instance, of the air-cooled radiator that is found in most automobiles. A pump 14 draws fluid 11 from condenser 12 and increases the pressure on that fluid to approximately 600 p.s.i.g. in a conduit 15, that . pressure being controlled by pressure relief valve 16, which opens to allow excess fluid 11 in conduit 15 to return to condenser 12. For an effective engine system, the pressure downstream of pump 14 could be set as low as approximately 300 p.s.i.g. or as high as approximately 800 p.s.i.g. The value chosen depends on the strength of the materials employed in constructing the engine system and on the performance required from the system.

The flow of fluid 11 out of conduit 15 is also controlled by a pressure control valve 17 which meters the amount of fluid 11 passing through an injector 18 into an annular combustion chamber 20. Heat is transferred to chamber 20 from the combustion of propane fuel stored in tank 21 by means of a burner element 22; it is possible to alternately use other fuels, such as natural gas, gasoline, oil or other hydrocarbon fuels. The heat is applied to combustion chamber 20 until the temperature of the fluid 11 in chamber 20 is approximately 300 degrees Fahrenheit. As with the pressure values selected, this temperature value is selected for purposes of the preferred embodiment; a greater or lesser value could be selected. A heat sensor 24 senses the temperature in chamber 20 and provides a controlling feedback signal to burner element 22. Burner element 22 is anticipated to be a complete-combustion very-high-efficiency unit of the type commonly now being installed in home heating furnaces.

When pressure control valve 17 is opened, liquid refrigerant fluid 11 is injected through injector 18 into combustion chamber 20 at the 600 p.s.i.g. pressure in conduit 15. As fluid 11 comes into contact with the heated chamber 20, it is transformed from the liquid phase into the gaseous phase. A pressure sensor 26 senses the pressure in chamber 20 and provides a controlling feedback signal to pressure control valve 17 to limit the pressure in chamber 20 to approximately 500 p.s.i.g. A pressure as high as 800 p.s.i.g. might be selected if appropriately strong materials were utilized for chamber 20.

Figure 3:
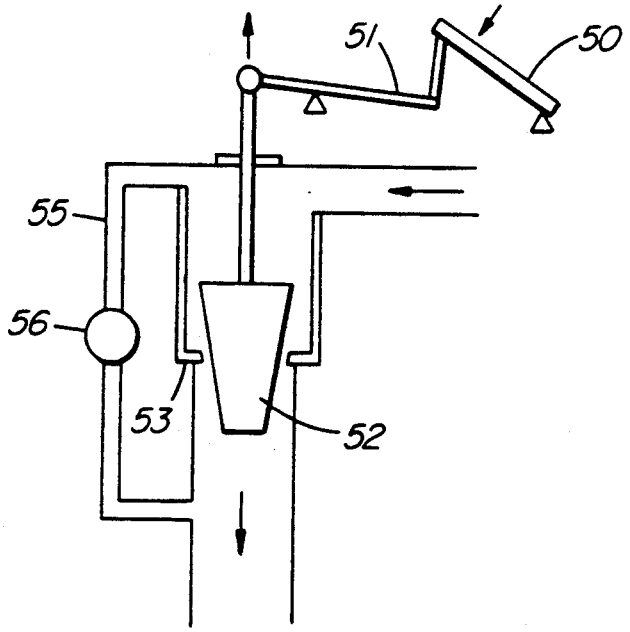
FIG. 3 is a sectioned view of a throttle assembly for the engine system of the preferred embodiment.
Figure 4A:
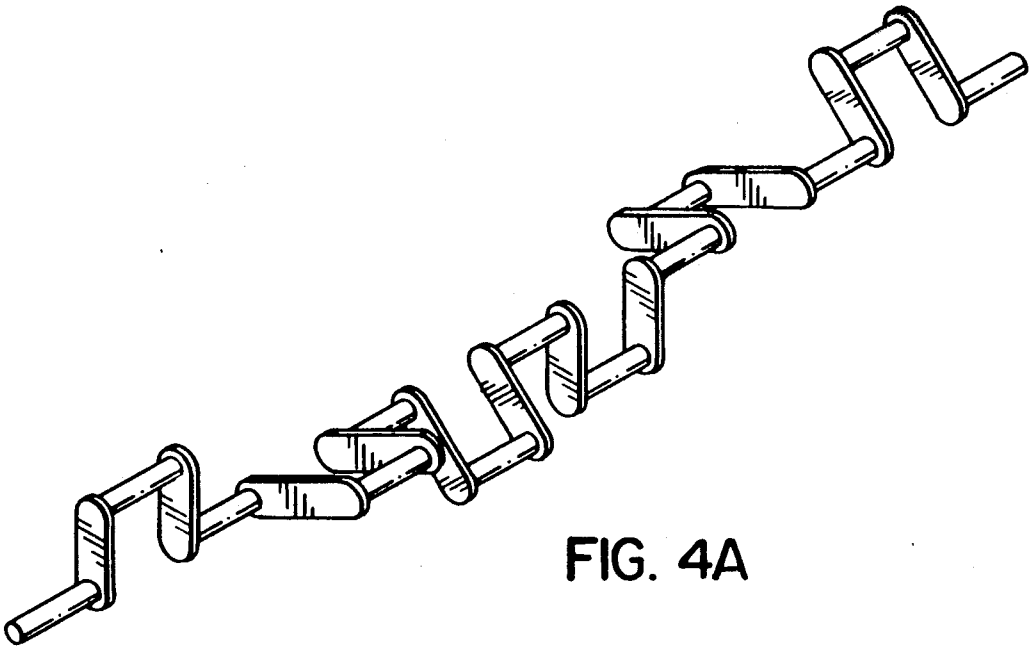
FIG. 4A is a schematic view of a first type of crankshaft used in the engine of FIG. 1, the view illustrating six journals on the crankshaft sitting in the same plane through the axis of the crankshaft.
Figure 4B:
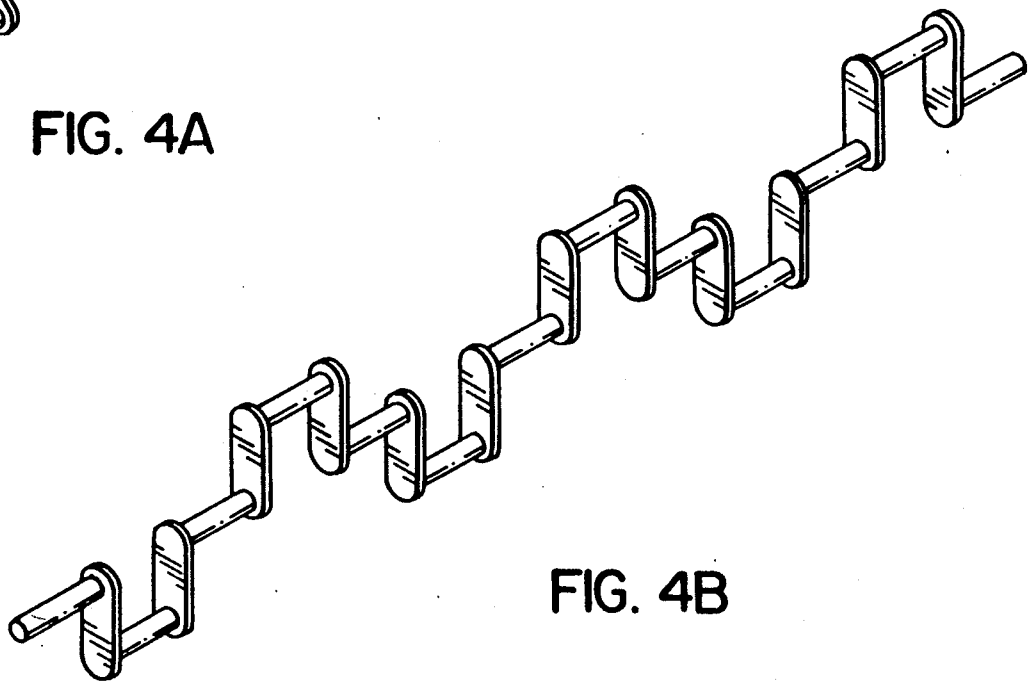
FIG. 4B is a schematic view of a second type of crankshaft used in the engine of FIG. 1, the view illustrating six journals on the crankshaft sitting in three planes equiangularly positioned around the axis of the crankshaft.

To start a two-stroke high-compression-ratio engine generally designated as 30 in FIG. 1, a pressure control valve 31 is slowly opened. Control valve 31 could be a throttle assembly as shown in FIG. 3, the operation of which will be subsequently described. Engine 30 of the preferred embodiment has an even number of cylinders 31, each having a piston 33 with rings 34 connected by means of a connecting rod 35 to a crankshaft 36. An engine with an odd number of cylinders could also be implemented; however, such an engine would be more complex because of the careful balancing required. In the preferred embodiment of the engine 30, the journals are arranged in pairs, one member of each pair extending in a direction angularly-opposed on crankshaft 36 from the other member of the pair. Each pair of journals occupy a respective one of a series of planes that divide a circle normal to and centred on the crankshaft into a set of equiangular segments. For instance, in a four-cylinder engine the journals extend at 90-degree intervals, whereas in a six-cylinder engine the journals extend at 60-degree intervals, etc. A crankshaft associated with a six-cylinder engine using this arrangement is shown in FIG. 4A. It is also possible, although less preferred, to place all of the journals of crankshaft 36 into a single plane, such that half of the journals of crankshaft 36 are positioned angularly-opposite the other half of the journals relative to the axis of rotation of crankshaft 36. A crankshaft associated with a six-cylinder engine having this arrangement is shown in FIG. 4B. With this arrangement, when half of the pistons 33 in engine 30 are at top dead center, the other half of the pistons 33 are at bottom dead center. For purposes of more even power distribution, an engine having the staggered journal position illustrated by FIG. 4A is preferred.

Figure 2B:
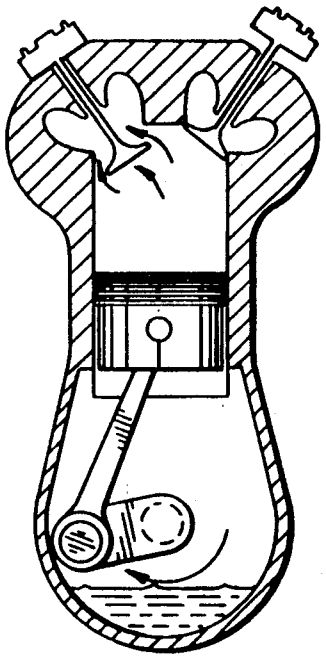
FIG. 2B is a partially-sectioned view of the two-stroke engine of FIG. 2A, but illustrating the cylinder piston in its upward motion.
Figure 2A:
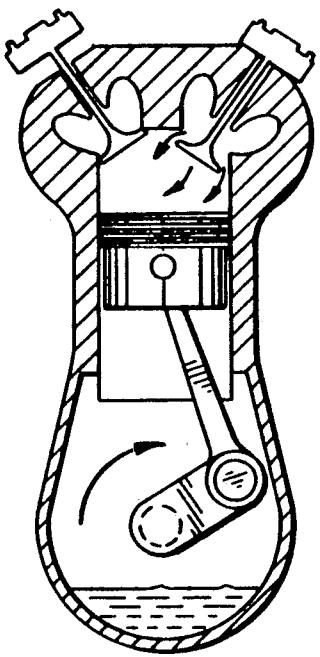
FIG. 2A is a partially-sectioned view of the two-stroke engine of the preferred embodiment, the view being taken through one cylinder on the downward motion of the cylinder piston.
Figure 5:
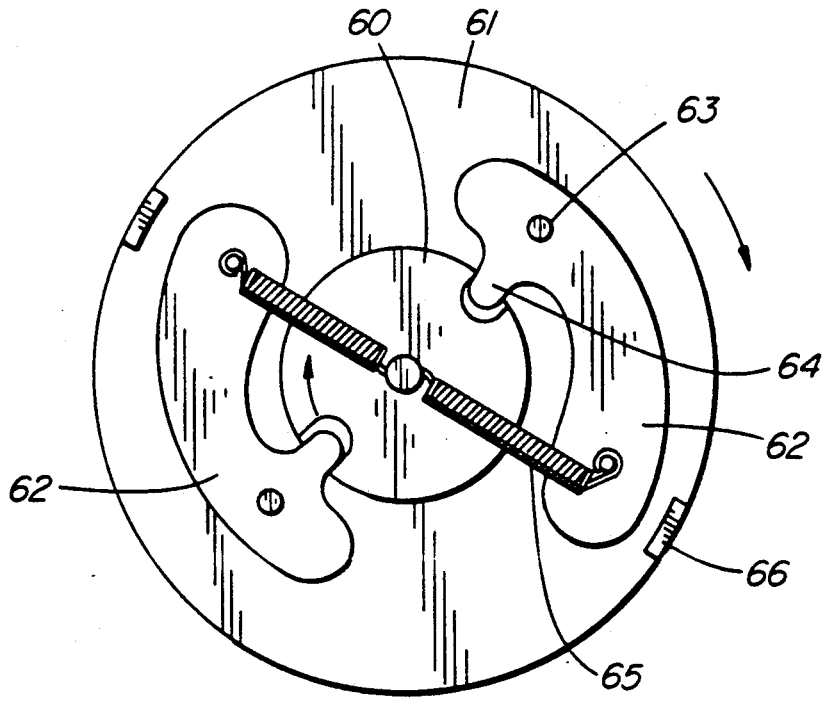
FIG. 5 is a plan view of a centrifugal mechanism for advancing the opening of the inlet valve means of the engine with increases in the rotational speed of the crankshaft.

Associated with each cylinder 31 is an inlet valve 38 and an outlet valve 39, as shown in FIGS. 1, 2A and 2B. The opening and closing of the valves 38 and 39 is controlled by a cam member (not shown) that is connected to crankshaft 36 through a centrifugal advancement mechanism which is illustrated in FIG. 5 and described more fully subsequently. The opening and closing of engine inlet and outlet valves by means of cam member rotation is assumed to be known to those skilled in the art of engine construction and is not further described.

As the gaseous refrigerant fluid 11 (at 500 p.s.i. g. in this embodiment) enters those cylinders 31 that have their inlet valves 38 open, fluid 11 creates a downward pressure on the pistons 33 in those cylinders. Each inlet valve 38 is connected to a cam member on the crankshaft such that it remains in the open state during the time that the respective piston 33 moves from a few degrees past top dead center (TDC) to a value between approximately one-quarter and approximately one-half of the downward motion of the associated piston. Experimentation has found that acceptable engine performance is obtained over a range extending from approximately 30 degrees past TDC to approximately 120. degrees past TDC. As each piston 33 moves past BDC the outlet valve 39 on its respective cylinder 31 opens (due to cam member position at that time). Because the engine utilized in this system is a high-compression-ratio engine having a compression ratio of at least 12-to-1, the pressure of refrigerant fluid 11 at the point at which outlet valve 39 opens has been reduced to a value between approximately 0 p.s.i.g. and 50 p.s.i.g. due to the downward motion of the piston 33. The actual value of the pressure of fluid 11 in cylinders 31 at BDC depends upon the ambient temperature of the air surrounding the engine system and the type of refrigerant gas used. For each piston 33 that is commencing its upward motion in its respective cylinder, another piston 33 is commencing its downward motion in its respective cylinder (the two pistons being angularly-opposed on crankshaft 36). The cam member is shaped such that the outlet valves 39 remain open for expulsion of the refrigerant fluid 11 during approximately the whole upward motion of each piston 33, i.e. from the time the piston 33 passes through BDC to almost the time it passes through TDC. To avoid contact between a piston 33 and an inlet valve 38 or an outlet valve 39 as the piston passes through TDC, the valves are either recessed into the head of the engine or the face of each piston is shaped to accommodate the valves. FIGS. 2A and 2B illustrate the downward and upward motion of the pistons 33, respectively, and the relative position of inlet valves 38 and outlet valves 39.

From the outlet valves 39, the 'spent' refrigerant fluid 11 moves at a pressure of between 0 p.s.i.g. and 50 p.s i.g. and a temperature of approximately 90 degrees Fahrenheit through an exhaust conduit 40 to the condenser 12. In condenser 12 heat is removed from fluid 11 through air-cooling or other means, and fluid 11 is transformed from the gaseous state into the liquid state. Fluid 11 then repeats its working cycle. Conduit 41 provides flow communication between the inside of crankcase 42 of engine 30 and the inside of condenser 12 for preventing a build-up of pressure within crankcase 42. Engine 30 has an oil pump (not shown) for pumping oil 43 from the base of crankcase 42 through channels terminating in the walls of the cylinders 31. A pressure relief valve 44 ensures that if the pressure in combustion chamber 20 exceeds 500 p.s.i.g. by more than a defined margin, valve 44 opens and the excess refrigerant gas is passed through conduit 45 directly to condenser 12. Between conduit 46 carrying fluid 11 into engine 30 and conduit 40 carrying fluid 11 away from engine 30 is a vacuum break 47, which is a small valved conduit which opens to allow fluid 11 to flow from conduit 40 to conduit 46 whenever the conduit 46 experiences a negative pressure above a predetermined value. Vacuum break 47 is necessary for the smooth operation of engine 30 during those times when throttle 31 is closed.

The preferred embodiment of the two-stroke engine has an even number of cylinders, i.e. 2, 4, 6, 8, etc., with parallel flow communication between the pressure control valve 31 and all of the inlet valves 38. Similar parallel flow communication exists between all of the outlet valves 39 and the condenser 12. The amount of working fluid power available to the engine is maintained at a generally constant level by means of feedback through heat sensor 24 and pressure sensor 26. Heat sensor 24 signals burner element 22 to increase the amount of heat provided if the temperature in combustion chamber 20 drops below approximately 300 degrees Fahrenheit. Similarly, pressure sensor 26 signals pressure control valve 17 to increase the flow rate of working fluid to injector 18 if the pressure in combustion chamber 20 drops below approximately 500 p.s. i.g. Control valve 31 is used to vary the amount of available working fluid power that is actually transmitted to engine 30.

One construction of control valve 31 suitable for use with an engine system installed in an automobile is shown in FIG. 3. The depression of a foot pedal 50 rotates a lever arm 51 clockwise, raising a tapered plunger 52 from an annular seat 53 to allow a controlled amount of fluid 11 to flow to engine 30. An idle by-pass line 55, with an associated idle control valve 56, may be built into the system to allow a small amount of fluid 11 sufficient for idling to flow to engine 30 even at times when valve 31 is closed.

FIG. 5 illustrates a centrifugal advancement mechanism that may be used to advance the opening and closing of the inlet valves 38 and outlet valves 39 as the rotational speed of crankshaft 36 increases. Shaft 60 is connected to crankshaft 36 through a belt or chain to rotate directly with crankshaft 36. Disc 61 is mounted on shaft 60 such that it can rotate slightly relative to shaft 60. Mounted to disc 61 to rotate with that disc is a cam member (not shown) on which a cam follower rides for opening and closing the inlet valves 38 and outlet valves 39. A pair of arms 62 are each rotatable on a respective heavy pivot pin 63. Each arm 62 has an ear 64 extending into a complementary groove in the side of shaft 60. A spring 65 is connected between the one end of each arm 62 and a pin on the rotational axis of shaft 60. A pair of stops 66 limit the outward movement of the arms 62. Slight relative rotational movement between shaft 60 and disc 61 occurs as shaft 60 increases its rotational speed. By this arrangement, the inlet valves 38 open a few degrees before TDC at high rotational speed of crankshaft 36; this allows the working fluid 11 to enter the cylinders at an earlier point than would be possible without this mechanism. When the engine 30 is just starting to rotate, the springs 65 hold the arms 62 at their most inward position which results in the inlet valves opening at TDC or just past TDC.

In an automobile incorporating this engine system, the condenser 12 is replaced by an air-cooled radiator similar to the radiator in existing automobiles but larger. Also, an electric starter engine may need to be utilized for starting engines in which the crankshaft has its journals all in one plane (as exemplified by the crankshaft of FIG. 4B). For engines in which the crankshaft has journals angularly distributed about its axis (as exemplified by the crankshaft of FIG. 4A), such a starter engine is not required. An electric pump (powered by a battery in the automobile) is required for initial pressurization of the refrigerant fluid 11 in conduit 15. After starting of the engine, the pressurization of that fluid may be transferred to a mechanical pump driven by the engine.

Figure 6:
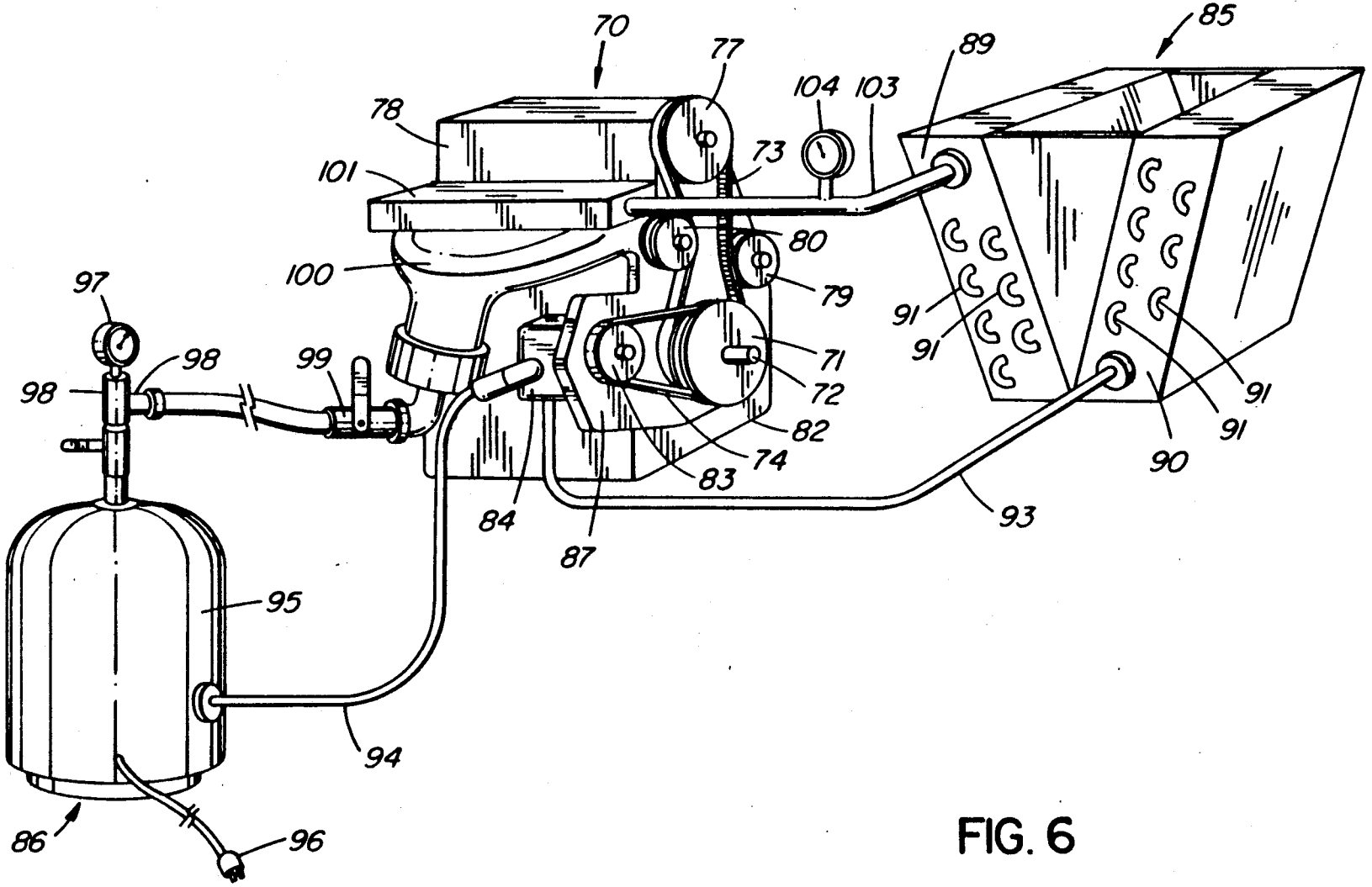
FIG. 6 is a perspective view of an experimental apparatus utilized for testing of the engine system of the preferred embodiment.

FIG. 6 illustrates an experimental apparatus which was built to test the feasibility of the engine system described. Engine 70 is a four-cylinder Volkswagen diesel engine with a compression-ratio of approximately 15:1. This type of engine has a crankshaft with four journals all extending in the same plane in a similar manner to the arrangement of FIG. 4B. The diesel fuel injectors and glow plugs of engine 70 were left in position but were left unconnected for the experiments. A pulley 71, secured to the end of a crankshaft 72, drives a pair of belts 73 and 74. The belt 73 extends around a pulley 77 which, through a linkage inside of casing 78, controls the opening and closing of the inlet and outlet cylinder valves of engine 70. The belt 73 also extends around a pulley 79 driving an oil pump (not shown), and around an idler pulley 80 mounted for free rotation on block 82 of engine 70. The belt 74 extends around a pulley 83 connected to a pump 84 which pumps refrigerant fluid in the liquid state from a radiator means generally designated 85 to a heater means generally designated 86. Pump 84 is secured to the block 82 by a bracket 87.

With further reference to the experimental apparatus illustrated in FIG. 6, the radiator means 85 is comprised of two radiator elements 89 and 90 secured together at an angle so as to create a wedge-shaped central cavity. Each of the radiator elements 89 and 90 comprises in part a continuous metal tube, each tube having a series of segments extending in parallel within the respective radiator element. Each of the semi-circular segments 91 that extend from the end of the radiator elements 89 and 90 connect a respective pair of the parallel segments of the continuous tube extending through the respective radiator element. A fan (not shown) is used to blow air across radiator means 85.

The refrigerant fluid 11 in the liquid phase was pumped from radiator means 85 along conduit 93 by pump 84. Pump 84 raised the pressure of fluid 11 from approximately 20 p.s.i.g. in radiator means 85 to approximately 600 p.s. i.g. in a downstream conduit 94. The conduit 94 extended into the heater means 86, which in the experiment consisted of a modified propane storage tank 95 within which was fitted an electrical heating element (not shown) connected to an electrical powercord 96. The refrigerant fluid 11 was transformed from the liquid phase to a gas having a pressure of approximately 500 p.s.i.g. by means of the heat supplied by the heating element within tank 95. The gas pressure was monitored by a pressure gauge 97 fitted to an output conduit 98 of tank 95. A control valve 99 was fitted into conduit 98 to control flow of the refrigerant fluid 11 to the input manifold 100 of engine 70. The input manifold 100 provided a reservoir for the refrigerant gas being introduced into the four cylinders of the engine through the inlet valves on those cylinders. The refrigerant gas leaving the cylinders through the outlet valves entered the output manifold 101 at approximately 20 p.s.i. g., and was then carried by a conduit 103 back to the radiator means 85. A pressure gauge 104 monitored the pressure in conduit 103.

The refrigerant fluid that was utilized for the experiments was dichlorotetrafluoroethane, which is known commercially to refrigeration engineers under the trademark "FREON 114". However, new 'environmentally-friendly' refrigerant fluids will shortly be commercially available that will have both higher operating pressures and lower condensation pressures. Although the engine system of the invention is a closed system in which there is no more leakage to the environment than results from use of the ordinary household refrigerator, the new refrigeration fluids presently under development do not use fluorohydrocarbons. One such 'ozone-friendly' gas which is close to commercial production is 2,2,Dichloro-1,1,1,TrifluoroEthane, which is being developed by Dupont Chemical Company and will carry the trade-mark "HCFC 123".

The engine system of this invention has been found to operate at least twice as efficiently in terms of output energy to input energy as conventional hydrocarbon-fuel internal combustion engine systems in use in automobiles.

We claim:

1. An engine system adapted to employ a refrigerant working fluid and comprising:

(a) a condenser for removing heat from the working fluid, the working fluid being thereby transformed from a gaseous state to a liquid state;

(b) a heating chamber;

(c) a pump for pumping the working fluid in the liquid state from the condenser to the heating chamber;

(d) a heat source for supplying heat to the heating chamber, the working fluid being thereby transformed from the liquid state to the gaseous state;

(e) a high-compression-ratio piston engine having reciprocating pistons connected to a rotatable crankshaft, the crankshaft having a series of journals each connected by a respective connecting rod to a respective one of the pistons, each piston being housed in a cylinder having a working fluid inlet valve means and a working fluid outlet valve means, the total of all of he inlet valve means controlling flow of the working fluid to the engine from the heating chamber, the total of all the outlet valve means controlling flow of the working fluid to the condenser from the engine, the rotation of the crankshaft determining the opening and closing of each of the inlet and outlet valve means, each inlet valve means being open between approximately one-quarter and approximately one-half of the downward motion of the associated piston, and each outlet valve means being open for substantially all of the upward motion of the associated piston; and (f) a centrifugal advancement mechanism for advancing the opening and closing of each of the inlet and outlet valve means relative to the rotation of the crankshaft, the advancement mechanism comprising, firstly, a shaft connected to rotate with the crankshaft. secondly, a concentric cylinder mounted to surrond the shaft, the concentric cylinder being connected to a camshaft that determines the opening and closing of each of the inlet and outlet valves means, and thirdly, a pair of arms mounted on the concentric cylinder such that each arm extends diametrically opposite the other on the cylinder, each arm being pivotally mounted on the cylinder such that a larger end of the arm moves outwardly on the cylinder against bias with increasing rotational speed of the cylinder, a second smaller end of each arm having a portion extending generally radially inwardly into the shaft;

whereby, an increase in the rotational speed of the shaft results in a rotation of the arms which in turn result in the concentric cylinder rotating slightly relative to the shaft to advance the opening and closing of the inlet and outlet valve means relative to the rotation of the crankshaft.

2. An engine system adapted to employ a refrigerant working fluid and comprising:

(a) a condenser for removing heat from the working fluid, the working fluid being thereby transformed from a gaseous state to a liquid state;

(b) a heating chamber;

(c) a pump for pumping the working fluid in the liquid state from the condenser to the heating chamber;

(d) a heat source for supplying heat to the heating chamber, the working fluid being thereby transformed from the liquid state to the gaseous state;

(e) a two-stroke high-compression-ratio piston engine having reciprocating pistons connected to a rotatable crankshaft, each piston occupying a respective one of an even number of cylinders of the engine, the crankshaft having a series of journals arranged in pairs such that one of each pair extends in a direction angularly-opposed on the crankshaft from the other of that pair, each pair of journals occupying a respective one of a series of planes that together divide a circle normal to and centered on the crankshaft into a set of equiangular segments, a series of connecting rods each connecting a respective one of the pistons to a respective one of the journals, each cylinder having a working fluid inlet valve means and a working fluid outlet valve means, the total of the inlet valve means controlling flow of the working fluid to the engine from the heating chamber, the total of the outlet valve means controlling flow of the working fluid to the condenser from the engine, the rotation of the crankshaft determining the opening and closing of the inlet and outlet valve means, each inlet valve means being open between approximately one-quarter and approximately one-half of the downward motion of the associated piston, and each outlet valve means being open for substantially all of the upward motion of the associated piston; and, (f) a centrifugal advancement mechanism for advancing the opening and closing of each of the inlet and outlet valve means relative to the rotation of the crankshaft, the advancement mechanism comprising, firstly, a shaft connected to rotate with the crankshaft, secondly, a concentric cylinder mounted to surround the shaft, the concentric cylinder being connected to a camshaft that determines the opening and closing of each of the inlet and outlet valve means, and thirdly, a pair of arms mounted on the concentric cylinder such that each arm extends diametrically opposite the other on the cylinder, each arm being pivotally mounted on the cylinder such that a larger end of the arm moves outwardly on the cylinder against bias with increasing rotational speed of the cylinder, a smaller second end of each arm having a portion extending generally radially inwardly into the shaft;

whereby, an increase in the rotational speed of the shaft results in a rotation of the arm which in turn results in the concentric cylinder rotating slightly relative to the shaft to advance the opening and closing of the inlet and outlet valve means relative to the rotation of the crankshaft.

3. An engine system to employ a refrigerant working fluid and comprising:

(a) a condenser for removing heat from the working fluid, the working fluid being thereby transformed from a gaseous state to a liquid state;

(b) a heating chamber;

(c) a pump for pumping the working fluid in the liquid state from the condenser to the heating chamber;

(d) a heat source for supplying heat to the heating chamber, the working fluid being thereby transformed from the liquid state to the gaseous state;

(e) a two-stroke high-compression-ratio piston engine having reciprocating pistons connected to a rotatable crankshaft, each piston occupying a respective one of an even number of cylinders of the engine, a series of journals on the crankshaft all occupying one or the other of two angularly-opposed positions in the crankshaft, a first set of connecting rods connecting the pistons in a first half of the cylinders to the journals occupying one of the two positions on the crankshaft, a second set of connecting rods connecting the pistons in the second half of the cylinders to the journals occupying the other of the two positions on the crankshaft, each cylinder having a working fluid inlet valve means and a working fluid outlet valve means, the total of the inlet valve means controlling flow of the working fluid to the engine from the heating chamber, the total of the outlet valve means controlling flow of the working fluid to the condenser from the engine, the inlet valve means on the first half of the cylinders moving together and outlet valve means on those cylinders moving together, the inlet valve means on the second half of the cylinders moving together and the outlet valve means on those cylinders moving together, each inlet valve means being open between approximately one-quarter and approximately one-half of the downward motion of the associated piston, each outlet valve means being open for substantially all of the upward motion of the associated piston; and (f) a centrifugal advancement mechanism for advancing the opening and closing of each of the inlet and outlet valve means relative to the rotation of the crankshaft, the advancement mechanism comprising, firstly, a shaft connected to rotate with the crankshaft, secondly, a concentric cylinder mounted to surround the shaft, the concentric cylinder being connected to a camshaft that determines the opening and closing of each of the inlet and outlet valve means, and thirdly, a pair of arms mounted on the concentric cylinder such that each arm extends diametrically opposite the other on the cylinder, each arm being pivotally mounted on the cylinder such that a larger end of the arm moves outwardly on the cylinder against bias with increasing rotational speed of the cylinder, a smaller second end of each arm having a portion extending generally radially inwardly into the shaft;

whereby, an increase in the rotational speed of the shaft results in a rotation of the arms which in turn results in the concentric cylinder rotating slightly relative to the shaft to advance the opening and closing of the inlet and outlet valve means relative to the rotation of the crankshaft.

* * * * *